US009609966B2

(12) United States Patent
White

(10) Patent No.: US 9,609,966 B2
(45) Date of Patent: Apr. 4, 2017

(54) DISPOSABLE CUP WITH REMOVABLE SCRIPTURE STICKERS

(71) Applicant: Shirley Ann White, Riviera Beach, FL (US)

(72) Inventor: Shirley Ann White, Riviera Beach, FL (US)

( * ) Notice: Subject to any disclaimer, the term of this patent is extended or adjusted under 35 U.S.C. 154(b) by 175 days.

(21) Appl. No.: 14/633,322

(22) Filed: Feb. 27, 2015

(65) Prior Publication Data

US 2016/0249754 A1 Sep. 1, 2016

(51) Int. Cl.
*A45C 11/00* (2006.01)
*A47G 19/22* (2006.01)

(52) U.S. Cl.
CPC ..... *A47G 19/2227* (2013.01)

(58) Field of Classification Search
USPC ..... 206/19, 459.5; 434/245
See application file for complete search history.

(56) References Cited

U.S. PATENT DOCUMENTS

| | | | | |
|---|---|---|---|---|
| 2,947,584 | A * | 8/1960 | Harris | A47B 97/04 40/124.5 |
| 5,456,351 | A * | 10/1995 | Johnson | A47G 19/2227 206/19 |
| 5,924,869 | A * | 7/1999 | Haas | A47G 33/00 40/518 |
| 6,022,570 | A * | 2/2000 | Richmond | A45F 3/18 206/19 |
| 8,166,686 | B2 | 5/2012 | Junkins | |
| 8,267,250 | B2 | 9/2012 | D'Amato | |
| 2008/0142394 | A1 | 6/2008 | Thuesen et al. | |
| 2008/0305461 | A1* | 12/2008 | Nichols | G09B 1/32 434/236 |
| 2013/0019460 | A1* | 1/2013 | Mayes | A47G 33/00 29/592.1 |
| 2015/0313384 | A1* | 11/2015 | Christopher | A47G 19/025 428/3 |

* cited by examiner

*Primary Examiner* — Jacob K Ackun
(74) *Attorney, Agent, or Firm* — Dunlap Bennett & Ludwig PLLC

(57) ABSTRACT

A cup with a lid and removable scripture stickers is provided. The cup includes an inner surface, an outer surface, and a rim forming an opening into the cup. The lid is releasably attachable to the rim of the cup, thereby covering the opening. At least one sticker having a scripture is attached to the outer surface of the cup. A folded paper is releasably attached to the top of the lid.

1 Claim, 3 Drawing Sheets

DISPOSABLE CUP WITH REMOVABLE SCRIPTURE STICKERS

BACKGROUND OF THE INVENTION

The present invention relates to inspiring scriptures and, more particularly, to a disposable cup with removable scripture stickers.

Current paper cups either do not display inspirational messages or, if they do, the messages are discarded along with the cup. Further, carrying a Bible or other source to search for Scriptures/inspirational messages or having to look up Scriptures on a phone or computer is burdensome.

As can be seen, there is a need for a disposable cup with removable scripture stickers.

SUMMARY OF THE INVENTION

In one aspect of the present invention, an apparatus for displaying scripture comprises: a cup comprising an inner surface, an outer surface, and a rim forming an opening into the cup; a lid releasably attached to the rim of the cup, thereby covering the opening; at least one sticker comprising a scripture, wherein the at least one sticker is attached to the outer surface of the cup; and a folded paper releasably attached to a top of the lid.

In another aspect of the present invention, a method of keeping a scripture for viewing at a later time comprises: providing a coffee cup comprising: a cup portion comprising an inner surface, an outer surface, and a rim forming an opening into the cup; a lid releasably attached to the rim of the cup, thereby covering the opening; at least one sticker comprising a scripture, wherein the at least one sticker is attached to the outer surface of the cup; and a folded paper releasably attached to a top of the lid; removing the folded paper from the top of the lid; unfolding the folded paper to form an unfolded paper; removing the at least one sticker from the outer surface of the cup; and attaching the at least one sticker to the unfolded paper.

These and other features, aspects and advantages of the present invention will become better understood with reference to the following drawings, description and claims.

DETAILED DESCRIPTION OF THE INVENTION

Figure 1:
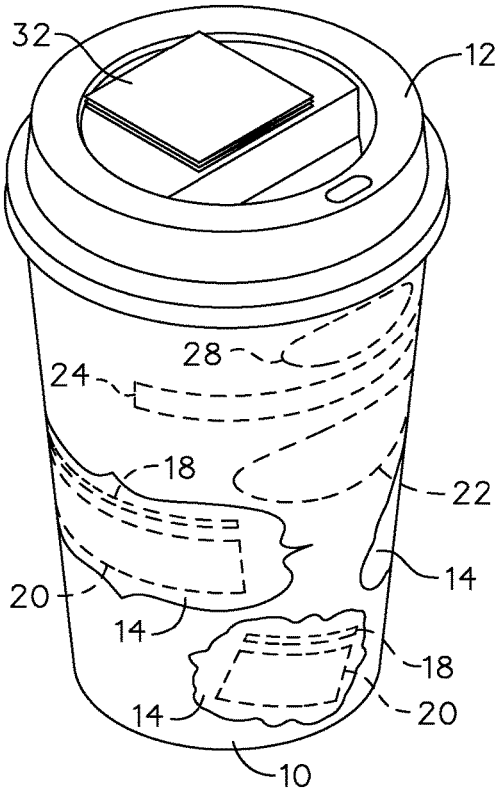
FIG. 1 is a front perspective view of an embodiment of the present invention.
Figure 2:
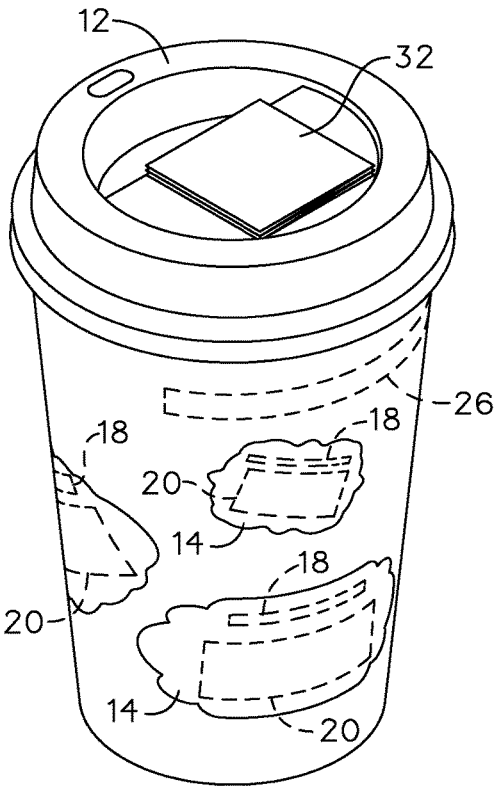
FIG. 2 is a rear perspective view of an embodiment of the present invention.
Figure 3:
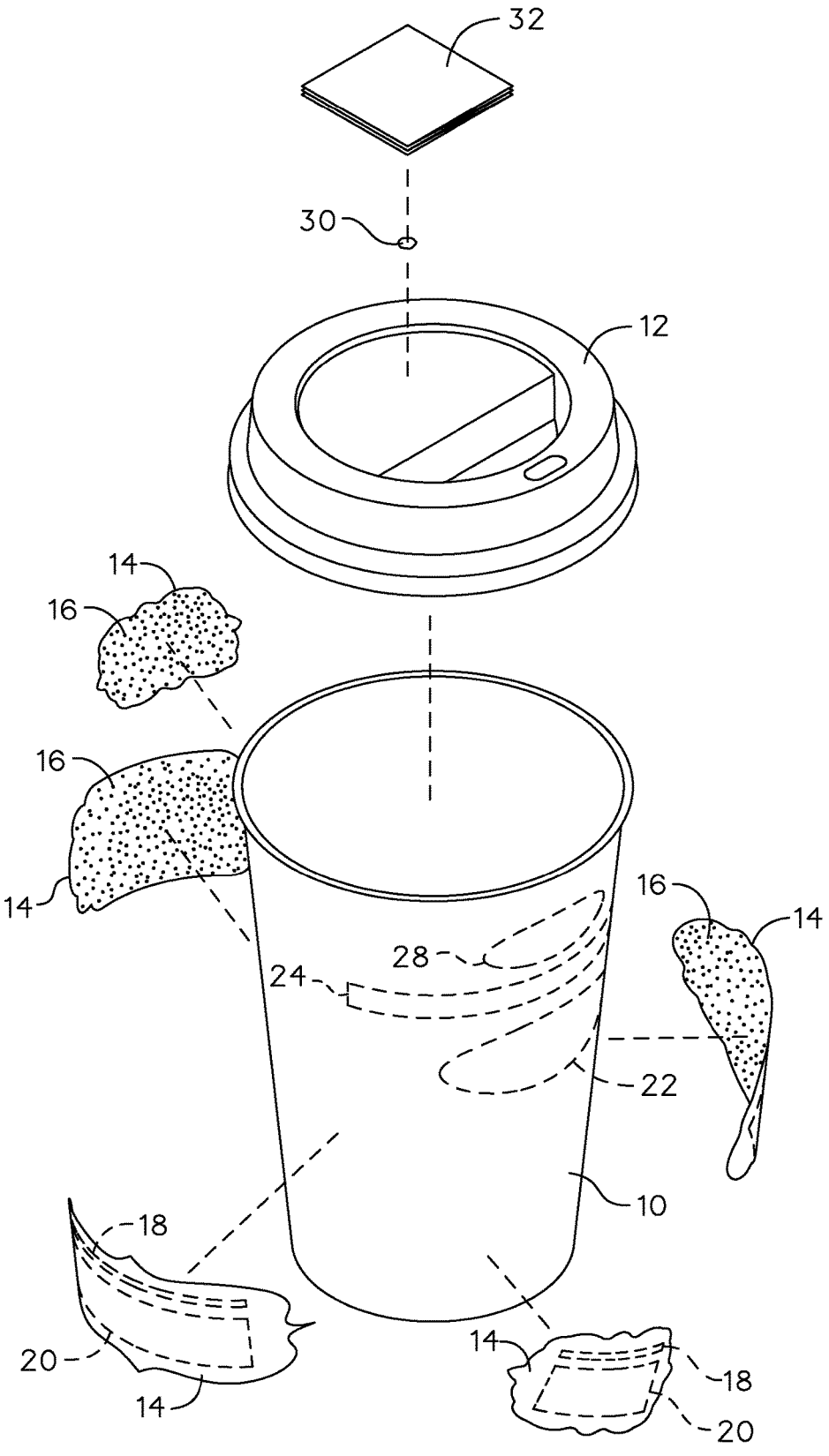
FIG. 3 is an exploded view of an embodiment of the present invention.

The following detailed description is of the best currently contemplated modes of carrying out exemplary embodiments of the invention. The description is not to be taken in a limiting sense, but is made merely for the purpose of illustrating the general principles of the invention, since the scope of the invention is best defined by the appended claims.

The present invention includes a disposable paper cup with removable scriptures related to a theme. The present invention displays scriptures and inspirational messages related to a theme on a disposable paper/coffee cup which a person may remove, place on a blank paper, and take with them to refer to those messages throughout the day, or at a later date, to encourage them.

The present invention includes removable adhesive scriptures and themes placed on the disposable cup. The cup lid is to be placed on top of the cup. The pre-packaged folded paper is lightly glued to cup lid to be removed to apply scriptures and themes. The removable inspirational scriptures/messages and theme are removed from the disposable cup along with the folded paper attached to the cup lid. The scriptures are reapplied to the folded paper and are readily available for encouragement.

Referring to FIGS. 1 through 4, the present invention includes a cup 10 and a lid 12. The cup 10 includes an inner surface, an outer surface, and a rim forming an opening into the cup 10. The lid 12 is releasably attachable to the rim of the cup 10, thereby covering the opening. At least one sticker 14 having a scripture 20 is attached to the outer surface of the cup 10. A folded paper 32 is releasably attached to the top of the lid 12.

The at least one sticker 14 of the present invention may include a plurality of stickers 14 attached to the outer surface of the cup 10. The stickers 14 may include an adhesive back 16 so that the sticker 14 may stick to the cup 10 and the folded paper 32. The sticker 14 may include a scripture 20 on the front surface, such as a Bible verse or an encouraging statement. In certain embodiments, the sticker 14 may also include a heading 18 that states the subject matter of the scripture 20.

The cup 10 of the present invention may be a disposable coffee cup. In certain embodiments, the cup 10 may include a theme of the stickers text 22, a picture 28 of a business logo, a first text logo area 24, and a second text logo area 26. The first text logo area 24 may include the script "Inspiration on the Go." The second text logo area 26 may include the script "Hope for the Heart." However, the scripts may vary depending on the company selling the present invention.

Figure 4:
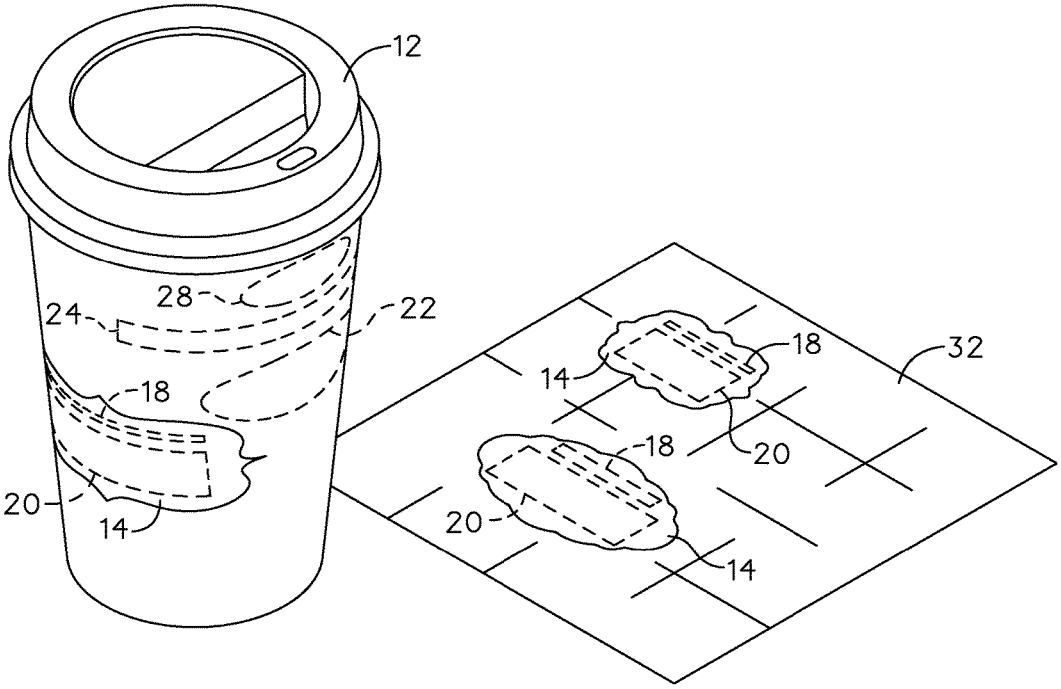
FIG. 4 is a perspective of the present invention with the stickers placed on the unfolded paper.

The folded piece of paper 32 may be secured to the top of the lid 12 by a glue dot 30 so that the paper 32 may easily be peeled off of the lid 12 for use. As illustrated in FIG. 4, the paper 32 may be unfolded, and the stickers 14 may be placed onto the paper 32. A user may throw away their empty cup of coffee while keeping the inspirational or Biblical scripts of the stickers 14 on the piece of paper 32.

A method of using the present invention may include the following. The coffee cup 10 mentioned above may be provided. The coffee within the cup 10 may be consumed. When the user is ready to throw away the cup 10, the user may remove the folded paper 32 from the top of the lid 12. The user may unfold the paper 32 and remove the stickers 14 from the outer surface of the cup 10. The user may then adhere the stickers 14 onto the unfolded paper 32 and throw away the cup 10. Now the user has the stickers 14 with the scripture 20 on their person without having to carry around the cup 10.

It should be understood, of course, that the foregoing relates to exemplary embodiments of the invention and that modifications may be made without departing from the spirit and scope of the invention as set forth in the following claims.

What is claimed is:

1. A method of keeping a scripture for viewing at a later time comprising:

providing a coffee cup comprising:

a cup portion comprising an inner surface, an outer surface, and a rim forming an opening into the cup;

a lid releasably attached to the rim of the cup, thereby covering the opening;

at least one sticker comprising a scripture, wherein the at least one sticker is attached to the outer surface of the cup; and a folded paper releasably attached to a top of the lid;

removing the folded paper from the top of the lid;

unfolding the folded paper to form an unfolded paper;

removing the at least one sticker from the outer surface of the cup; and attaching the at least one sticker to the unfolded paper.

* * * * *